US008623178B2

(12) United States Patent
Ohyabu et al.

(10) Patent No.: US 8,623,178 B2
(45) Date of Patent: Jan. 7, 2014

(54) SLITTING-MATERIAL SLITTING APPARATUS, INKJET PAPER MANUFACTURING APPARATUS, METHOD OF MANUFACTURING INKJET PAPER

(75) Inventors: Tatsuhito Ohyabu, Kanagawa (JP); Kyohisa Uchiumi, Kanagawa (JP); Yoshiko Kojima, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 39 days.

(21) Appl. No.: 13/361,938

(22) Filed: Jan. 30, 2012

(65) Prior Publication Data

US 2012/0193057 A1 Aug. 2, 2012

(30) Foreign Application Priority Data

Feb. 2, 2011 (JP) ..... 2011-020798

(51) Int. Cl.
*D21G 9/00* (2006.01)
*B26D 1/143* (2006.01)
*B26D 1/24* (2006.01)

(52) U.S. Cl.
USPC ..... 162/285; 162/194; 162/286; 242/525.7; 83/500

(58) Field of Classification Search
USPC ..... 162/194, 260, 283, 285, 286; 400/621, 400/621.1; 83/495, 496, 500, 503; 242/525, 242/525.6, 525.7
See application file for complete search history.

(56) References Cited

U.S. PATENT DOCUMENTS

| | | | | |
|---|---|---|---|---|
| 3,994,193 | A * | 11/1976 | Bodycomb | 83/501 |
| 5,974,922 | A | 11/1999 | Camp et al. | |
| 2001/0052279 | A1 | 12/2001 | Sanda et al. | |
| 2004/0255743 | A1 | 12/2004 | Kawai | |
| 2009/0025525 | A1 | 1/2009 | Sanda et al. | |
| 2009/0025526 | A1 | 1/2009 | Sanda et al. | |
| 2011/0239840 | A1 * | 10/2011 | Ohyabu et al. | 83/505 |

FOREIGN PATENT DOCUMENTS

| | | |
|---|---|---|
| JP | 2001-315089 | 11/2001 |
| JP | 2001-341397 | 12/2001 |
| JP | 2005-7525 | 1/2005 |
| JP | 2005-14106 | * 1/2005 |
| JP | 2007-257695 | 10/2007 |
| JP | 2009-291950 | 12/2009 |

* cited by examiner

*Primary Examiner* — Eric Hug
(74) *Attorney, Agent, or Firm* — SOLARIS Intellectual Property Group, PLLC

(57) ABSTRACT

There is provided a slitting-material slitting apparatus including: a rotatable male blade; a female blade that is provided below the male blade; and a wrap section that wraps a slitting-material around the female blade such that the slitting-material makes contact with the female blade on a coated layer side of the slitting-material configured by a support body with a coating layer on the support body harder than the support body; wherein the relative position of the male blade and the female blade are determined such that the male blade slits the slitting-material in a state in which the coating layer is wrapped against the female blade by the wrap section and in contact with the female blade.

9 Claims, 9 Drawing Sheets

FIG.6A

CRACKING SUPPRESSION EFFECT

| | | Blade Tip Angle of Secondary blade | | | | |
|---|---|---|---|---|---|---|
| | | 30° | 45° | 60° | 85° | 90° |
| No Secondary blade | | C | NG | C | B | A |
| Thickness of Secondary blade | 10 μm | C | C | B | A | A |
| | 50 μm | C | C | B | A | A |
| | 80 μm | C | C | B | B | A |

FIG.6B

BURR SUPPRESSION EFFECT

| | | Blade Tip Angle of Secondary blade | | | | |
|---|---|---|---|---|---|---|
| | | 30° | 45° | 60° | 85° | 90° |
| No Secondary Blade | | A | C | NG | NG | NG |
| Thickness of Secondary blade | 10 μm | A | B | B | B | NG |
| | 50 μm | A | B | B | B | NG |
| | 80 μm | A | C | C | NG | NG |

FIG.6C

EVALUATION CRITERIA

| Evaluation | Burring | Cracking |
|---|---|---|
| A | 0 to 50 μm | 0 to 10 individual cracks/m |
| B | 50 to 100 μm | 10 to 20 individual cracks/m |
| C | 100 to 150 μm | 20 to 40 individual cracks/m |
| NG | 150 μm or over | 40 or more individual cracks/m |

FIG.7A

CHANGE IN WORKING LIFE DUE TO TOP AND BOTTOM KNIFE BEVELED PORTIONS

| | | Top Knife | | | |
|---|---|---|---|---|---|
| | | 0 μm | 1 μm | 10 μm | 15 μm |
| Bottom Knife | 0 μm | NG | NG | NG | NG |
| | 1 μm | NG | A | A | B |
| | 10 μm | NG | A | A | B |
| | 15 μm | NG | B | B | B |

FIG.7B

EVALUATION CRITERIA

| | |
|---|---|
| NG | 100 000 m or less |
| B | 100 000 m to 500 000m |
| A | 500 000m or more |

FIG.8A

| Knife Conditions | Top Knife | Bevel 3 μm | Bevel 3 μm | Bevel 3 μm | Bevel 3 μm | Bevel 3 μm |
|---|---|---|---|---|---|---|
| | | Secondary Blade 45°, 25 μm | Secondary Blade 60°, 10 μm | Secondary Blade 60°, 50 μm | Secondary Blade 85°, 10 μm | Secondary Blade 85°, 50 μm |
| | Bottom Knife | Bevel 4 μm | Bevel 4 μm | Bevel 4 μm | Bevel 4 μm | Bevel 4 μm |
| Number of Cracks (Individual Cracks/m) | | C | B | B | A | A |
| Top Knife Side | Burring | B | B | B | B | B |
| Bottom Knife Side | Burring | B | B | B | B | B |

FIG.8B

EVALUATION CRITERIA

| Evaluation | Burr | Crack |
|---|---|---|
| A | 0 to 50 μm | 0 to 10 individual cracks/m |
| B | 50 to 100 μm | 10 to 20 individual cracks/m |
| C | 100 to 150 μm | 20 to 40 individual cracks/m |
| NG | 150 μm or over | 40 or more individual cracks/m |

SLITTING-MATERIAL SLITTING APPARATUS, INKJET PAPER MANUFACTURING APPARATUS, METHOD OF MANUFACTURING INKJET PAPER

CROSS-REFERENCE TO RELATED APPLICATION

This application is based on and claims priority under 35 USC 119 from Japanese Patent Application No. 2011-020798 filed on Feb. 2, 2011, the disclosure of which is incorporated by reference herein.

BACKGROUND

1. Technical Field

The present invention relates to a slitting apparatus for slitting-material formed with a coating layer on a support body, and to an inkjet paper manufacturing apparatus and a method of manufacturing inkjet paper.

2. Related Art

Technology for slitting inkjet paper formed with a relatively hard coating layer on a support body is known, in which the inkjet paper is slit from the coating layer side with a highly raked male blade while supporting the inkjet paper with a female blade (see for example the specification of US Patent Application Publication No. 2004/0255743). Technology for slitting photographic paper by slitting from the support body side is also known (see for example the specification of U.S. Pat. No. 5,974,922).

However, it is difficult to achieve a good cut face when slitting a slitting-material having a coating layer harder than the support body from the coating layer side with a male blade, with this being a cause of poor yield. On the other hand, when a slitting-material having a coating layer harder than the support body is slit with a male blade from the support body side, there is concern regarding damage to the surface of the coating layer due to rubbing of the coating layer accompanying relative displacement between the coating layer of the slitting-material and a support member and female blade.

SUMMARY

The present invention addresses suppressing cracking and burring (raised burr) from occurring in the vicinity of the slit edge of a coating layer during slitting.

The first aspect of the present invention provides a slitting-material slitting apparatus including:

a rotatable male blade;

a female blade that is provided below the male blade so as to be capable of rotating about a rotation axis aligned with the rotation axis direction of the male blade, and is provided so as to face a blade tip portion of the male blade along the male blade rotation axis direction; and a wrap section that wraps a slitting-material around the female blade such that the slitting-material makes contact with the female blade on a coated layer side of the slitting-material configured by a support body with a coating layer on the support body harder than the support body; wherein the relative position of the male blade and the female blade are determined such that the male blade slits the slitting-material in a state in which the coating layer is wrapped against the female blade by the wrap section and in contact with the female blade.

According to the above aspect, the female blade is provided below the rotating male blade so as to be capable of rotating about a rotation axis aligned with the rotation axis direction of the male blade, and so as to face a blade tip portion of the male blade along the male blade rotation axis direction.

Further, the wrap section wraps the slitting-material configured by the support body formed with the coating layer harder than the support body around the female blade such that the coated layer side of the slitting-material makes contact with the female blade.

The rotating male blade then slits the slitting-material wrapped in this manner against the female blade from the support body side. The male blade slits the slitting-material in a state in which the coating layer is wrapped against the female blade by the wrap section and is in contact with the female blade.

Due to this, slitting-material is slit in a stable state, and cracking and burring (raised burr) can be suppressed from occurring at the vicinity of the slit edge of the coating layer during slitting.

The second aspect of the present invention provides the slitting-material slitting apparatus of the first aspect, wherein:

a blade tip angle of the male blade as viewed from the rotation direction of the male blade is 15° to 30°; and a blade tip portion of the male blade is provided with a secondary blade that, when viewed from the rotation direction, has a rotation axis direction thickness of 10 μm to 50 μm and a blade tip angle of 60° to 85°.

According to the above configuration, the blade tip angle of the male blade as viewed from the rotation direction of the male blade is 15° to 30°, and the blade tip portion of the male blade is provided with a secondary blade that has a thickness of 10 μm to 50 μm and blade tip angle of 60° to 85°. Cracking and burring (raised burr) can accordingly be efficiently suppressed from occurring at the vicinity of the slit edge of the coating layer during slitting.

The third aspect of the present invention provides the slitting-material slitting apparatus of the first aspect, wherein a material of the male blade is cemented carbide.

According to the above configuration, the durability of the male blade can be raised (the working life can be prolonged) since the material of the male blade is cemented carbide.

The fourth aspect of the present invention provides the slitting-material slitting apparatus of the first aspect, wherein a blade tip angle of the female blade is 90°.

According to the above configuration, the female blade is easily fabricated, and the durability of the female blade can also be raised (the working life can be prolonged) due to the blade tip angle of the female blade being 90°.

The fifth aspect of the present invention provides the slitting-material slitting apparatus of the first aspect, wherein:

a male blade beveled portion is provided to a blade tip portion of the male blade facing towards the female blade, the male blade beveled portion having a bevel dimension along the rotation axis direction of 1 μm or greater; and a female blade beveled portion is provided to a blade tip portion of the female blade facing towards the male blade, the female blade beveled portion having a bevel dimension along the rotation axis direction of 1 μm or greater.

According to the above configuration, a male blade beveled portion is provided to the blade tip portion of the male blade facing towards the female blade, the male blade beveled portion having a bevel dimension along the rotation axis direction of 1 μm or greater, and a female blade beveled portion is provided to the blade tip portion of the female blade facing towards the male blade, the female blade beveled portion having a bevel dimension along the rotation axis direction of 1 μm or greater. The durability of the male blade and female blade can accordingly be further raised (the working life can be prolonged).

The sixth aspect of the present invention provides the slitting-material slitting apparatus of the fifth aspect, wherein the bevel dimension along the rotation axis direction of the male blade beveled portion is 10 μm or less and the bevel dimension along the rotation axis direction of the female blade beveled portion is 10 μm or less.

According to the above configuration, the bevel dimension along the rotation axis direction of the male blade beveled portion is 10 μm or less and the bevel dimension along the rotation axis direction of the female blade beveled portion is 10 μm or less. Therefore, the durability of the male blade and female blade can be efficiently raised (the working life can be prolonged).

The seventh aspect of the present invention provides the slitting-material slitting apparatus of the first aspect, wherein the material of the female blade is cemented carbide.

According to the above configuration the durability of the female blade can be raised (the working life can be prolonged) since the material of the female blade is cemented carbide.

The eighth aspect of the present invention provides the slitting-material slitting apparatus of the first aspect, wherein:

tension applied to the slitting-material is set in a range of 130N/m to 686N/m; and a degree of overlap of the male blade and the female blade is set in a range of 0.8 mm to 1.0 mm.

According to the above configuration, due to setting the tension applied to the slitting-material in the range of 130N/m to 686N/m, cracks can be suppressed from appearing in comparison to cases in which pulling is performed at a greater tension, and the slitting-material can also be slit in a stable state.

The degree of overlap of the male blade and the female blade is also set in the range of 0.8 mm to 1.0 mm, and accordingly the male blade can be suppressed from riding up on the female blade, and the slitting-material can be prevented from undergoing a large amount of deformation during slitting.

The ninth aspect of the present invention provides an inkjet paper manufacturing apparatus including:

a feeder section that feeds inkjet paper configured by a support body with an ink receiving layer harder than the support body formed on the support body to an inkjet paper conveying direction downstream side;

the slitting-material slitting apparatus of claim 1 that is provided on the conveying path of the inkjet paper and slits the inkjet paper that has been fed out by the feeder section along the conveying direction into a plurality of strips of inkjet paper; and a winding section that winds up the inkjet paper that has been slit by the slitting-material slitting apparatus.

According to the above configuration, the slitting-material slitting apparatus of one of the above aspects slits the inkjet paper that has been fed out from the feeder section into plural strips of inkjet paper along the conveying direction.

The winding section also winds up the inkjet paper that has been slit by the slitting-material slitting apparatus.

Due to the inkjet paper being slit by the slitting-material slitting apparatus of one of the above aspects of the present invention, cracking and burring (raised burr) can be suppressed from occurring at the vicinity of the slit edge of the coating layer during slitting.

The tenth aspect of the present invention provides a method of manufacturing inkjet paper, the method including:

feeding out inkjet paper configured by a support body formed with an ink receiving layer harder than the support body on the support body to the next process;

slitting, by using the slitting-material slitting apparatus of the first aspect, the inkjet paper that has been fed out by the feeding process; and winding up the inkjet paper that has been slit in the slitting process.

According to the above configuration, first, in the feeding process, the inkjet paper configured by the support body formed with the ink receiving layer harder than the support body is fed out to the next process.

Then, in the slitting process the slitting-material slitting apparatus of one of the above aspects is employed to slit the inkjet paper that has been fed out by the feeding process.

Then in the winding process the inkjet paper that has been slit in the slitting process is wound up.

Due to the inkjet paper being slit by the slitting-material slitting apparatus of one of the above aspects of the present invention, inkjet paper can be manufactured in which cracking and burring (raised burr) is suppressed from occurring at the vicinity of the slit edge of the coating layer.

According to the present invention cracking and burring (raised burr) can be suppressed from occurring at the vicinity of the slit edge of the coating layer during slitting.

BRIEF DESCRIPTION OF THE DRAWINGS

Exemplary embodiments of the present invention will be described in detail based on the following figures, wherein:

FIG. 6A is a table illustrating evaluation results when burring and cracking are evaluated employing a slitting apparatus according to an exemplary embodiment of the present invention and employing a slitting apparatus of comparative examples;

FIG. 6B is a table illustrating evaluation results when burring and cracking are evaluated employing a slitting apparatus according to an exemplary embodiment of the present invention and employing a slitting apparatus of comparative examples;

FIG. 6C is a table illustrating evaluation results when burring and cracking are evaluated employing a slitting apparatus according to an exemplary embodiment of the present invention and employing a slitting apparatus of comparative examples;

FIG. 7A is a table illustrating evaluation results of changes evaluated in working life (durability) employing a slitting apparatus according to an exemplary embodiment of the present invention and employing a slitting apparatus of comparative examples;

FIG. 7B is a table illustrating evaluation results of changes evaluated in working life (durability) employing a slitting apparatus according to an exemplary embodiment of the present invention and employing a slitting apparatus of comparative examples;

FIG. 8A is a table illustrating evaluation results when burring and cracking are evaluated employing a slitting apparatus according to an exemplary embodiment of the present invention and employing a slitting apparatus of comparative examples;

FIG. 8B is a table illustrating evaluation results when burring and cracking are evaluated employing a slitting apparatus according to an exemplary embodiment of the present invention and employing a slitting apparatus of comparative examples.

DETAILED DESCRIPTION

Explanation follows regarding a slitting-material slitting apparatus according to an exemplary embodiment of the present invention, an inkjet paper manufacturing apparatus and a method of manufacturing inkjet paper, with reference to FIG. 1 to FIG. 9.

Overall Configuration

Inkjet Paper Manufacturing Apparatus

Figure 9:
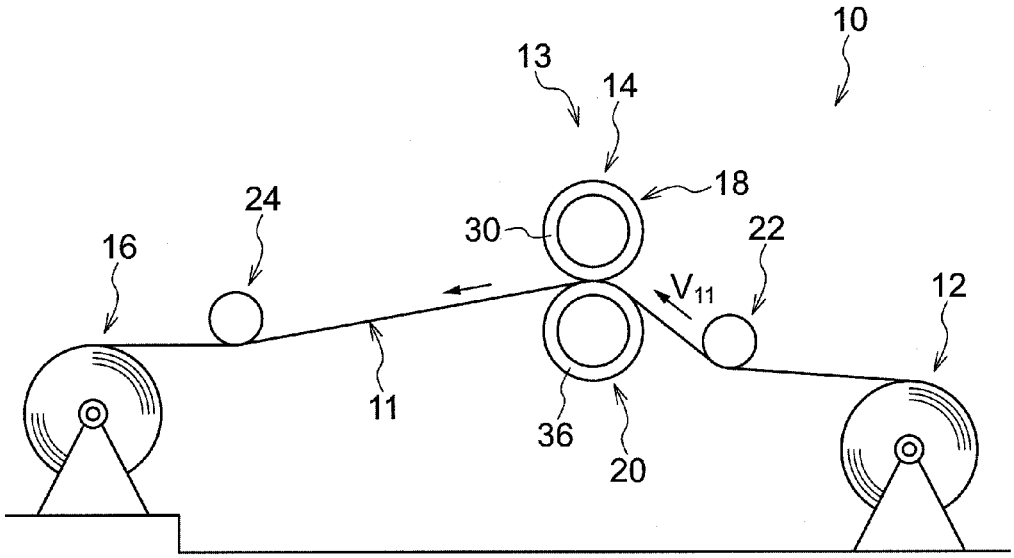
FIG. 9 is a schematic configuration diagram illustrating an inkjet paper manufacturing apparatus according to an exemplary embodiment of the present invention.

As shown in FIG. 9, an inkjet paper manufacturing apparatus 10 includes: a feeder section 12 serving as an example of a feeder section for feeding out inkjet paper 11 serving as slitting-material; a slitting-material slitting apparatus 13 (referred to below simply as a slitting apparatus) for slitting the inkjet paper 11 conveyed out from the feeder section 12 along the conveying direction; and a winding section 16 serving as an example of a winding section for winding up the inkjet paper 11 that has been slit by the slitting apparatus 13 and acting as a drive source.

The feeder section 12 successively feeds out the inkjet paper 11 that has been wound in roll-form, and the winding section 16 is configured so as to separately wind up the inkjet paper 11 that has been slit into plural narrow width strips of inkjet paper as respective rolls. Configuration is accordingly made such that the inkjet paper 11 is conveyed between the feeder section 12 and the winding section 16 (see the arrow in FIG. 9).

While described in more detail later, briefly the slitting apparatus 13 includes an apparatus body 14, and a guide roller 22 and a guide roller 24, serving as an example of a wrap section, described later. The apparatus body 14 is configured so as to pass the inkjet paper 11 between an upper knife unit 18 and a lower knife unit 20 so as to slit the inkjet paper 11 into plural sections disposed across the width direction (a direction orthogonal to the conveying direction) of the inkjet paper 11. The guide roller 22 is provided between the feeder section 12 and the apparatus body 14, and the inkjet paper 11 is wrapped on the guide roller 22. The guide roller 24 is provided between the slitting apparatus 13 and the winding section 16, and the inkjet paper 11 is wrapped through the apparatus body 14.

Figure 1:
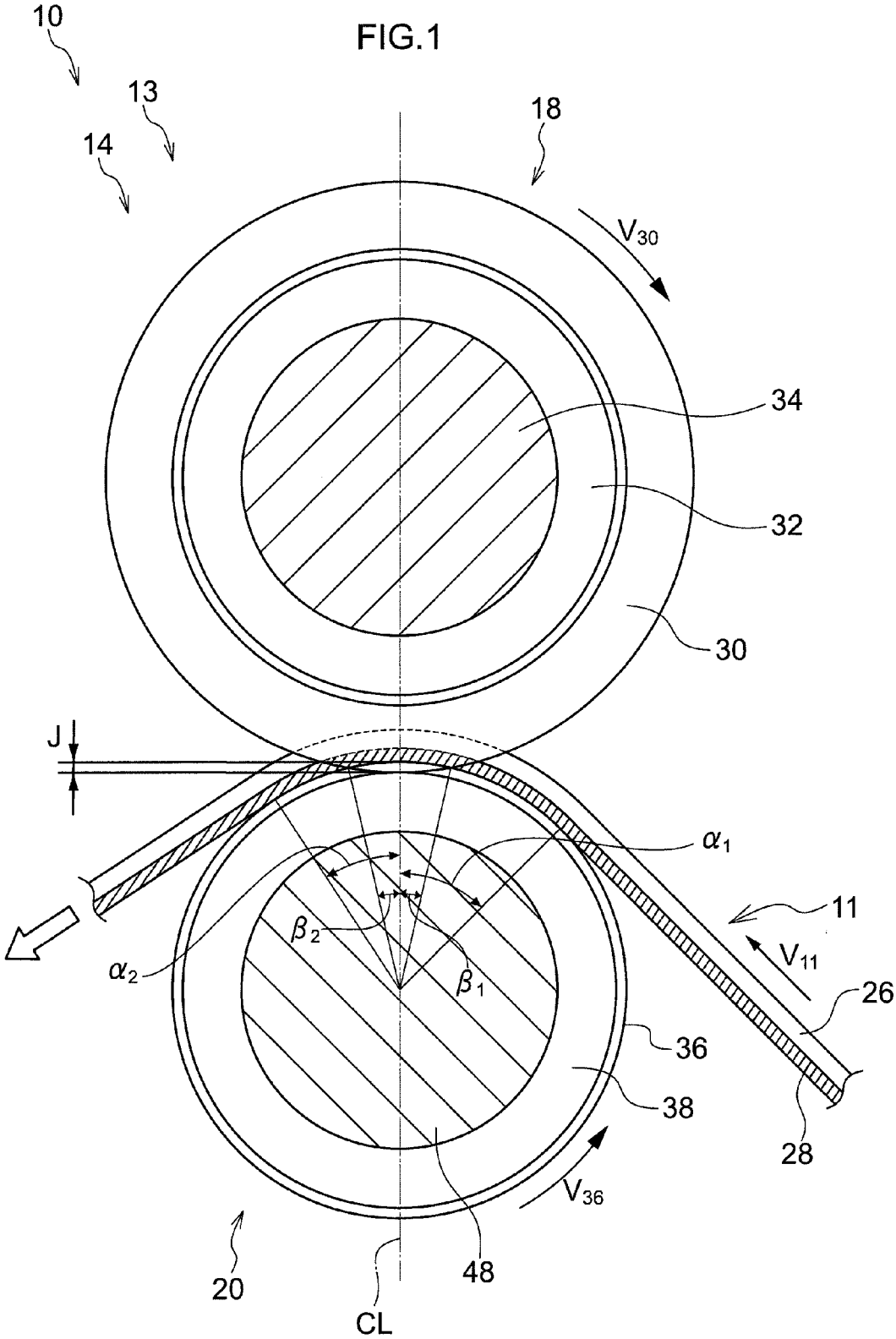
FIG. 1 is a side view illustrating a slitting apparatus main body according to an exemplary embodiment of the present invention.
Figure 3:
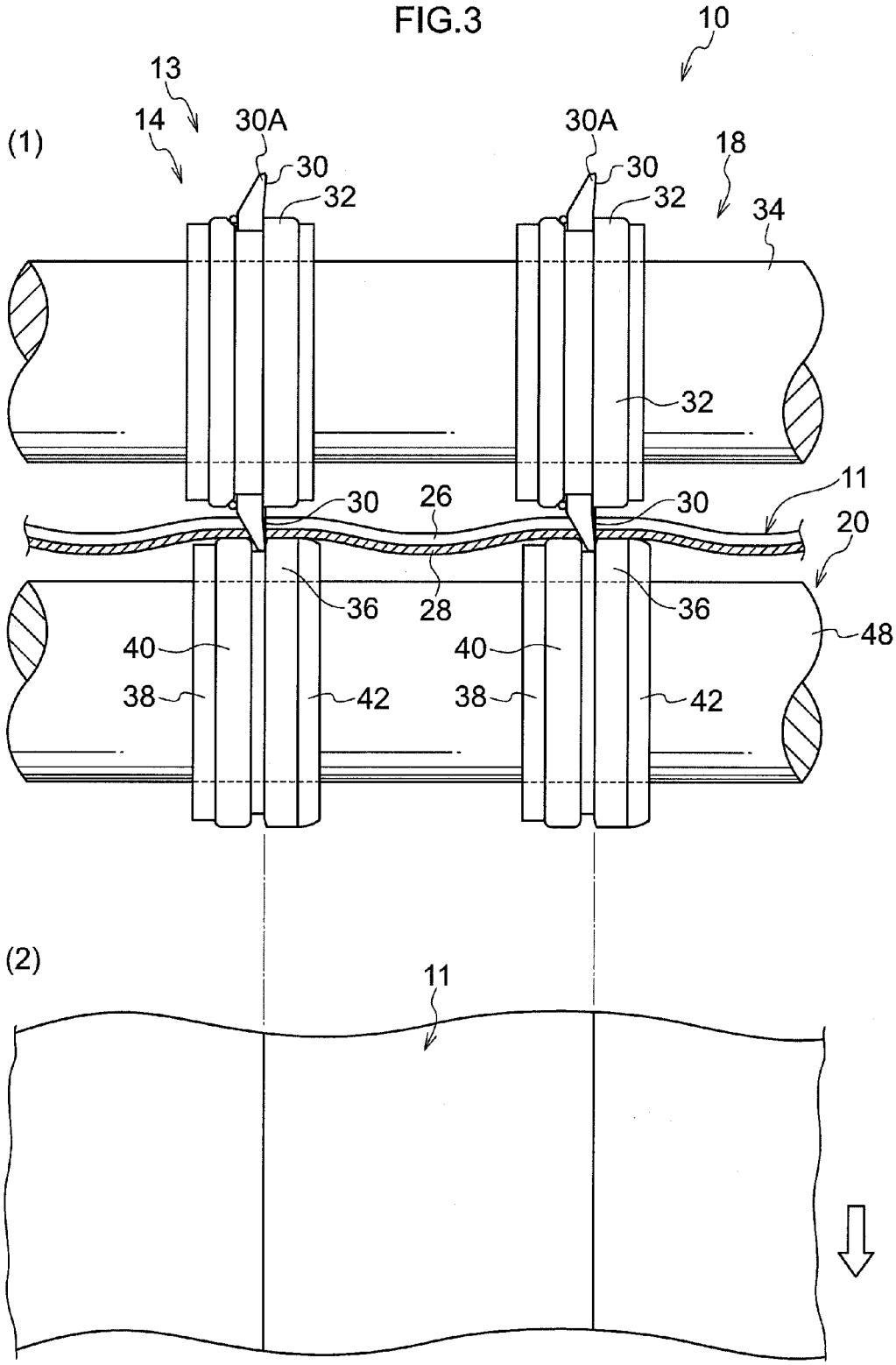
FIG. 3 illustrates a face-on view illustrating top knives and bottom knives employed in a slitting apparatus of an exemplary embodiment of the present invention, and illustrates inkjet paper that has been slit.

Further explanation follows regarding the inkjet paper 11. The inkjet paper 11 is, as shown in FIG. 1 and FIG. 3, configured by paper 26 serving as a support body, with an ink receiving layer 28 serving as a coating layer formed on one face of the paper 26. The ink receiving layer 28 is formed by coating the paper 26 with a coating liquid, containing such components as inorganic particles (silica in the present exemplary embodiment), a water soluble resin (for example a poly vinyl alcohol), a mordant (such as a cationic compound), and a bridging agent, then drying the coated paper 26. The silica forms a multi-porous network structure on one face of the paper 26. The ink receiving layer 28 is hence harder than the paper 26. Specific examples are described in JP-A No. 2010-30195 of materials that may be employed to configure the inkjet paper 11, such as papers, inorganic particles, water soluble resins, mordants and bridging agents.

Slitting Apparatus

Figure 4:
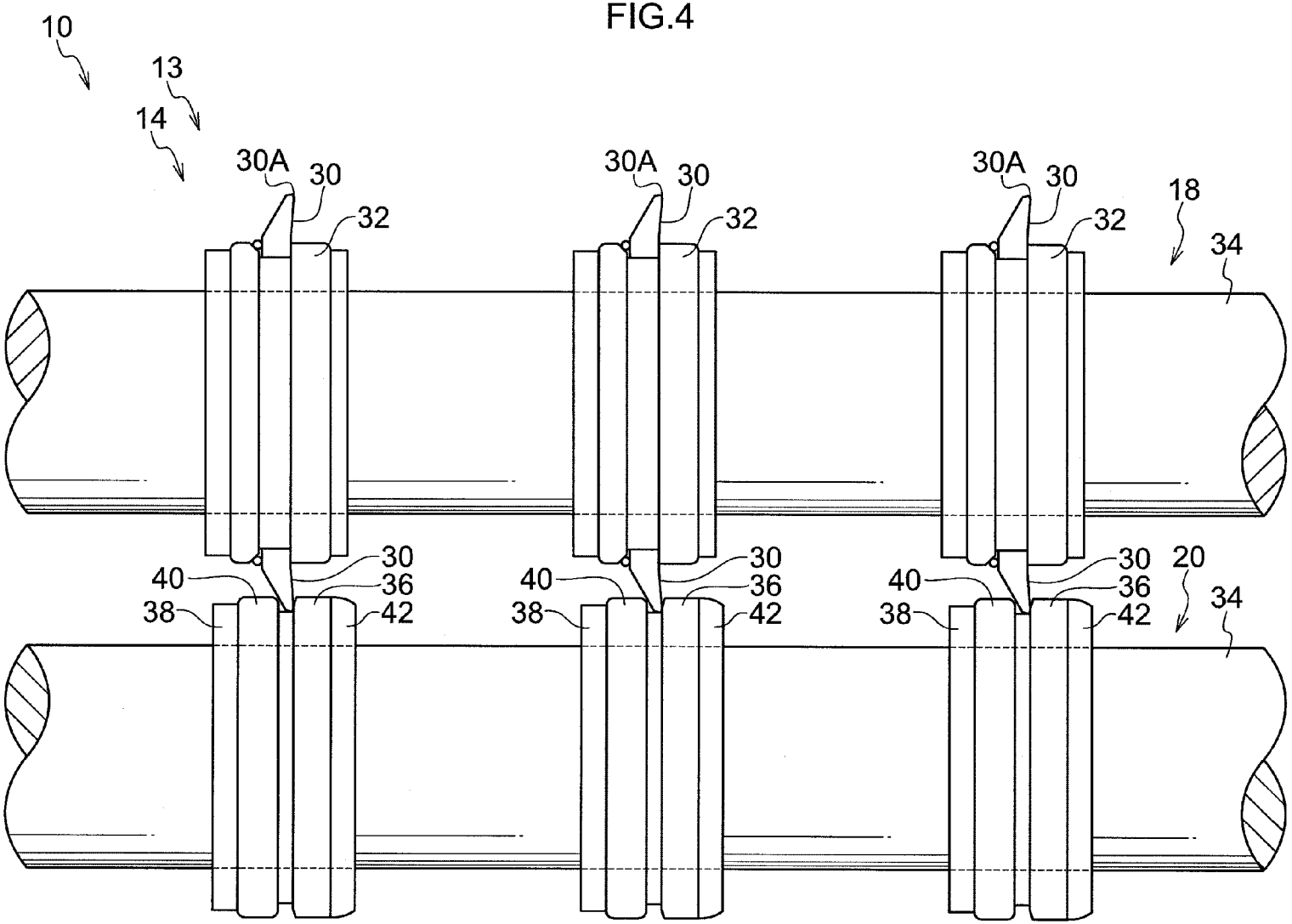
FIG. 4 is a face-on view illustrating top knives and bottom knives employed in a slitting apparatus of an exemplary embodiment of the present invention.

As shown in FIG. 1, FIG. 3(1) and FIG. 4, the upper knife unit 18 provided to the slitting apparatus 13 includes plural top knives 30, male blade holders 32 that hold base end portions of the top knives 30, and a male blade rotation shaft 34.

The top knives 30 are formed in circular ring shapes in side view (see FIG. 1), and the outermost peripheral portions of the top knives 30 are configured by sharp blade tip portions 30A that face towards the radial direction outside. Namely, the blade tip portions 30A are configured so as to gradually get thinner on progression towards the radial direction outside. Details are given later regarding the profile of the top knives 30 together with details regarding bottom knives 36.

The male blade holders 32 hold the top knives 30 coaxially with respect to the male blade rotation shaft 34 so as to rotate as one with the male blade rotation shaft 34. The male blade holders 32 are configured so as to provide adjustable hold positions for the top knives 30 along the rotation axis direction of the male blade rotation shaft 34 (referred to below simply as the rotation axis direction). Since adjusting structures applicable to the male blade holders 32 are known, further explanation thereof is omitted. In the slitting apparatus 13 the slit positions along the width direction of the inkjet paper 11, namely the widths of the inkjet paper 11 after slitting, are adjustable using the adjusting structure of the male blade holders 32.

Figure 5:
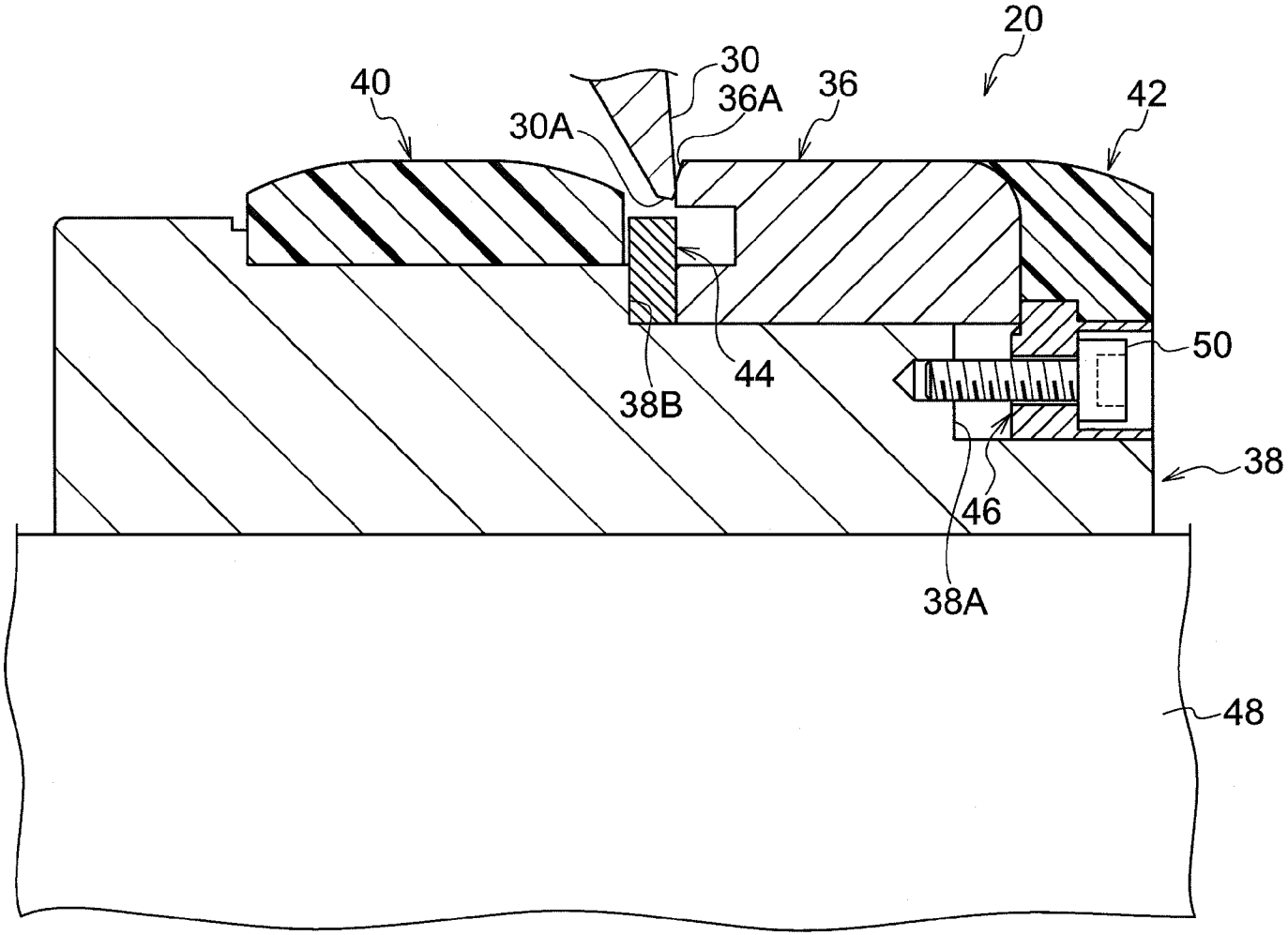
FIG. 5 is a cross-section illustrating a female blade unit employed in a slitting apparatus accordingly to an exemplary embodiment of the present invention.

As shown in FIG. 5, the lower knife unit 20 is configured with main components including the same number of bottom knives 36 as the number of top knives 30, female blade holder 38, collars 40 serving support members, cover members 42, intermediate rings 44 serving as spacer members, and a female blade rotation shaft 48.

Each of the female blade holders 38 is formed with a stepped profile as viewed from the rotation direction of the bottom knives 36, so as to be able to continue to hold the bottom knives 36, the collars 40, the cover members 42, the intermediate rings 44 and a pressing plate 46 while adjusting the holding position of these components along the rotation axis direction of the female blade rotation shaft 48. Adjusting structures applicable are also known and explanation thereof is omitted. In the slitting apparatus 13, using the adjusting structure of the lower knife unit 20 together with the adjusting structure of the upper knife unit 18 enables the slitting position of the inkjet paper 11 along the width direction, namely the width of the inkjet paper 11 after slitting, to be adjustable.

The bottom knives 36 are formed with a short circular cylindrical shaped profile, formed with blade tip portions 36A formed at outer peripheral portions of the bottom knives 36 at end portions along the rotation axis direction. Details regarding the bottom knives 36 are given later, together with details regarding the top knives 30.

The collars 40 are formed from a resin material, shaped into a short circular cylindrical shape with a circular cylindrical face on the outer peripheral face. The collars 40 are disposed with a gap to the bottom knives 36, and with the top knives 30 interposed therebetween.

The outer peripheral face of the collars 40 and the outer peripheral face of the bottom knives 36 project out further in the radial direction than other portions of the lower knife unit 20. The diameters of the collars 40 and the bottom knives 36 are substantially the same as each other, and are configured so as to support the inkjet paper 11 from the ink receiving layer 28 side, as shown in FIG. 3(1). Configuration is made such that the inkjet paper 11 is wrapped around the outer peripheral faces of the collars 40 and the bottom knives 36 in this supported state, as shown in FIG. 1.

As shown in FIG. 5, the blade tip portions 30A of the top knives 30 intrude in between the blade tip portions 36A and the collars 40 of the bottom knives 36, such that the blade tip portions 30A of the top knives 30 face the blade tip portions 36A of the bottom knives 36 along the rotation axis direction, and such that the top knives 30 slit the inkjet paper 11 from the paper 26 side (the opposite side to the coated side) while rotating.

The bottom knives 36 fit onto the stepped face of the stepped profile female blade holders 38, and are held on the female blade holders 38 by the pressing plate 46 fastened with bolts 50, so as to rotate as one with the female blade holder 38. More specifically, each of the pressing plates 46 presses against the respective female blade 36 at other end side (the opposite side to the blade tip portions 36A side) of the female blade 36, pressing the female blade 36 towards a step face 38B by the bolts 50 being screwed into through bolt holes passing through the pressing plate 46 and into threads formed in a step face 38A of the female blade holder 38. The intermediate rings 44 are disposed between the step faces 38B and the bottom knives 36. Namely, the bottom knives 36 are retained on the female blade holder 38 nipped between the pressing plates 46 and the intermediate rings 44.

The cover members 42 are molded from a resin material and are provided so as to cover the opposite side of the bottom knives 36 to the blade tip portion 36A side.

Configuration of Relevant Portions

Explanation follows regarding the top knives 30 and the bottom knives 36.

Figure 2:
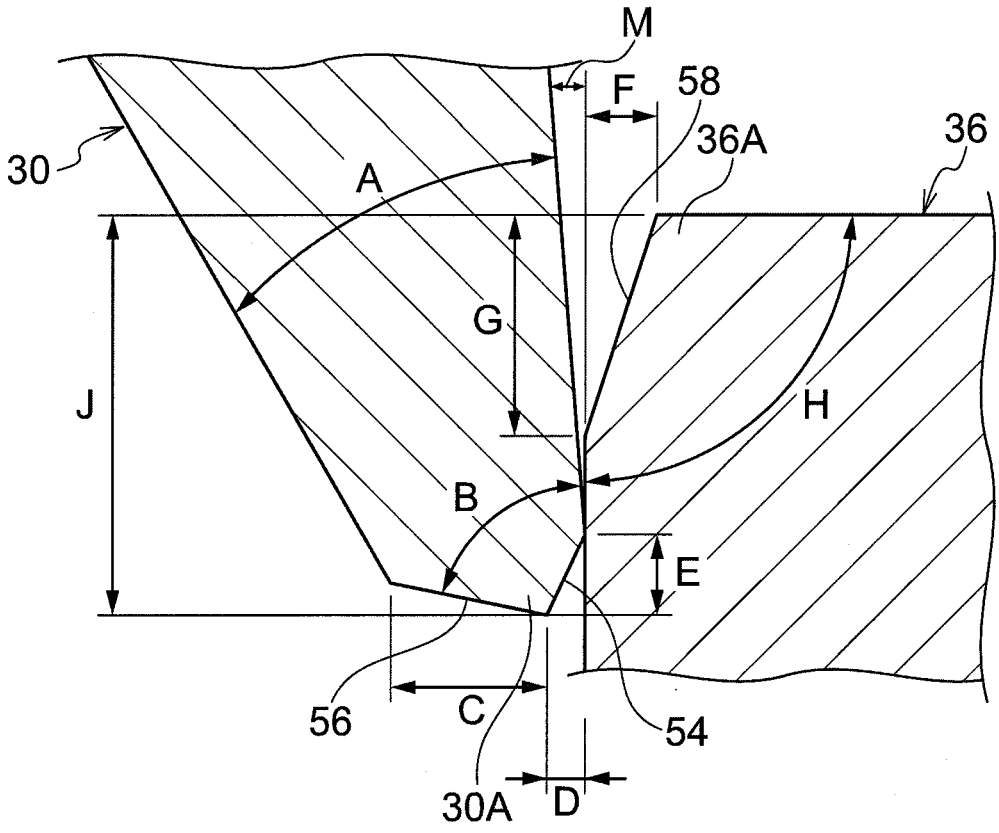
FIG. 2 is a cross-section illustrating a male blade and a female blade employed in a slitting apparatus according to an exemplary embodiment of the present invention.

As shown in FIG. 1 and FIG. 2, the material of the top knives 30 and the bottom knives 36 is cemented carbide, and in this exemplary embodiment the top knives 30 and the bottom knives 36 are configured from a hard material (Vickers hardness Hv 1500 or greater).

The degree of overlap (dimension J in FIG. 2) of the blade tip portions 30A of the top knives 30 and the blade tip portions 36A of the bottom knives 36 is set in a range of 0.8 mm to 1.0 mm, as viewed from the rotation direction of the top knives 30 and the bottom knives 36.

The tension acting on the inkjet paper 11 to be slit by the slitting apparatus 13 is set so as to be within the range of 130N/m to 686N/m, and is determined by such factors as the driving force and resistance of various component.

In the slitting apparatus 13, the peripheral velocity of the blade tip portions 30A of the top knives 30, peripheral velocity $V_{30}$, and the peripheral velocity of the blade tip portions 36A of the bottom knives 36, peripheral velocity $V_{36}$, are set faster than the conveying speed $V_{11}$ of the inkjet paper 11. The proportional speed increase relative to the conveying speed $V_{11}$ of the inkjet paper 11 on the male blade 30 side is 0 to 6%, and the proportional speed increase relative to the conveying speed $V_{11}$ of the inkjet paper 11 on the female blade 36 side is 0 to 0.24%.

As shown in FIG. 1, in the slitting apparatus 13 the relative positional relationship of the top knives 30 and the bottom knives 36 is set such that $\alpha 1>\beta 1$ and $\alpha 2>\beta 2$, wherein: $\alpha 1$ is the angle formed between a center line CL passing through the rotation axis centers of the male blade 30 and the female blade 36 and the position where the inkjet paper 11 first touches the female blade 36; $\alpha 2$ is the angle formed from the center line CL up to the position where the inkjet paper 11 separates from the female blade 36; $\beta 1$ is the angle formed from the center line CL to the position where the male blade 30 first intersects with the female blade 36; and $\beta 2$ is the angle formed from the center line CL to the position where the male blade 30 separates from the female blade 36. In the present exemplary embodiment, for example, the relative position of the guide roller 22 and the guide roller 24 with respect to the female blade 36 (see FIG. 9) is set such that $\alpha 1$ and $\alpha 2$ are 10° or greater. Accordingly a configuration is achieved in which the male blade 30 slits the inkjet paper 11 with the ink receiving layer 28 in a supported state on the outer peripheral face of the female blade 36.

Furthermore, as shown in FIG. 2, a male blade beveled portion 54 is provided to each of the blade tip portions 30A of the top knives 30 with a relief angle (or a clearance angle, the angle M in FIG. 2) of 3° set.

In the present exemplary embodiment, the bevel dimension in the rotation axis direction of the male blade beveled portion 54 (dimension D in FIG. 2) is 1 μm to 10 μm, and the bevel dimension in the radial direction (dimension E in FIG. 2) is 10 μm to 100 μm. More precisely, the male blade beveled portion 54 is provided such that if dimension D is X then the E dimension is 10 times X. For example if the dimension D is set at 1 μm then the E dimension is set at 10 μm, and if dimension D is set at 10 μm then the E dimension is set at 100 μm.

The blade tip angle (angle A in FIG. 2) of the male blade 30 as viewed from the rotation direction of the male blade 30 is set at 15° to 30°. Further, at the blade tip portions 30A of the top knives 30, there is provided a secondary blade 56 having a thickness of 10 μm to 50 μm in the rotation axis direction as viewed from the rotation direction of the top knives 30 (dimension C in FIG. 2) and a blade tip angle (angle B in FIG. 2) of 60° to 85°.

The blade tip angle of the bottom knives 36 as seen from the radial direction of the female blade 36 (angle H in FIG. 2) is set at 90°. A female blade bevel portion 58 is also provided to each of the blade tip portions 36A of the bottom knives 36.

In the present exemplary embodiment, the bevel dimension in the rotation axis direction of the female blade bevel portion 58 (dimension F in FIG. 2) is set at 1 μm to 10 μm, and the bevel dimension in the radial direction (dimension G in FIG. 2) is set at 10 μm to 100 μm. More precisely, the female blade bevel portion 58 is provided such that if the dimension F is X then the dimension G is 10 times X, for example if the dimension F is set at 1 μm then the dimension G is set at 10 μm, and if the dimension F is set at 10 μm then the dimension G is set at 100 μm.

Operation and Effect

Explanation follows regarding operation of the slitting apparatus 13 and the inkjet paper manufacturing apparatus 10 of the present invention, together with explanation of an inkjet paper manufacturing method of the present invention.

As shown in FIG. 9, the inkjet paper manufacturing apparatus 10 conveys the inkjet paper 11 at a specific conveying speed $V_{11}$ using the action of the feeder section 12 and the winding section 16.

As shown in FIG. 1, the inkjet paper 11 is guided by the guide roller 22 and introduced into the apparatus body 14 with a specific entry angle $\alpha 1$, and is guided by the guide roller 24 (see FIG. 9) out from the apparatus body 14 with a specific exit angle $\alpha 2$.

As shown in FIG. 3(1) and FIG. 3(2), in the apparatus body 14 the male blade 30 slits the inkjet paper 11 from the support body paper 26 side along the conveying direction. Therefore, a burr is suppressed from being raised from the outside face of the paper 26 of the inkjet paper 11.

As shown in FIG. 2, the blade tip angle (the angle A in FIG. 2) of the male blade 30 as viewed from the rotation direction is 15° to 30°. Furthermore, the secondary blade 56 is provided to the blade tip portions 30A of the top knives 30 with a rotation axis direction thickness as viewed from the rotation direction of the male blade 30 (dimension C in FIG. 2) of 10 μm to 50 μm, and a blade tip angle (angle B in FIG. 2) of 60° to 85°.

Namely, due to providing the secondary blade 56 with a rotation axis direction thickness (dimension C in FIG. 2) of 10 μm to 50 μm, and a blade tip angle of 60° to 85°, localized load is better prevented from being applied to the inkjet paper 11 when slitting the inkjet paper 11 than in cases with an acute blade tip angle of the secondary blade, thereby suppressing cracks from occurring in the inkjet paper 11.

Furthermore, by setting the blade tip angle of the top knives 30 (angle A in FIG. 2) at 15° to 30°, load is suppressed from occurring along the width direction of the inkjet paper 11 during slitting, and burring of the inkjet paper 11 is better suppressed from occurring that in cases with an obtuse blade tip angle of the top knives 30.

Evaluation was performed regarding cracking and burring with the blade tip angle of the male blade 30 (angle A of FIG. 2) set at 15° to 30° while varying values for the thickness of the secondary blade 56 (dimension C in FIG. 2) and the blade tip angle of the secondary blade 56 (angle B in FIG. 2) to various levels. For comparison evaluation was also performed of configurations without the secondary blade 56.

As shown in FIG. 6C, with respect to cracking evaluation is indicated as: A for 0 to 10 individual cracks per meter; B for 10 to 20 individual cracks per meter; C for 20 to 40 individual cracks per meter; and NG for 40 or more individual cracks per meter. With respect to burring evaluation is indicated as: A for 0 to 50 μm; B for 50 to 100 μm; C for 100 to 150 μm; and NG for 150 μm or greater.

It can be seen that, as shown in FIG. 6A and FIG. 6B, according to the present exemplary embodiment, evaluation for cracking and burring is either A or B when the secondary blade thickness (dimension C in FIG. 2) is 10 μm to 50 μm and the blade tip angle of the secondary blade 56 (angle B in FIG. 2) is 60° to 85°, and it can be seen that in the present exemplary embodiment cracking and burring are suppressed from occurring.

Furthermore, as shown in FIG. 2, the male blade 30 is provided with the male blade beveled portion 54 having a bevel dimension in the rotation axis direction (dimension D in FIG. 2) of 1 μm to 10 μm and a bevel dimension in the radial direction (dimension E in FIG. 2) of 10 μm to 100 μm. The female blade 36 is provided with the female blade bevel portion 58 having a bevel dimension in the rotation axis direction (dimension F in FIG. 2) of 1 μm to 10 μm and a bevel dimension in the radial direction (dimension G in FIG. 2) of 10 μm to 100 μm.

The durability is also evaluated while varying the bevel dimension in the rotation axis direction for the male blade bevel portion (dimension D in FIG. 2) and the bevel dimension in the rotation axis direction for the female blade bevel portion (dimension F in FIG. 2) to various levels.

As shown in FIG. 7B, evaluation is indicated as: A when the slitting distance without male blade or female blade breakage exceeds 500000 m; B when the distance without male blade of female blade breakage is 100000 m to 500000 m; and NG when distance without male blade of female blade breakage is less than 100000 m.

It can be seen that the present exemplary embodiment raises durability since, as shown in FIG. 7A, evaluation is A when, as in the present exemplary embodiment, the bevel dimension in the rotation axis direction for the male blade bevel portion (dimension D in FIG. 2) is 1 μm to 10 μm, and the bevel dimension in the rotation axis direction for the female blade bevel portion (dimension F in FIG. 2) is 1 μm to 10 μm.

Evaluation was performed based on the above evaluations to narrow down the range of the optimal conditions enabling both suppression of cracking and burring to be achieved.

Evaluation standards are, as shown in FIG. 8B, the same as previously, wherein with respect to cracks evaluation is indicated as: A for 0 to 10 individual cracks per meter; B for 10 to 20 individual cracks per meter; C for 20 to 40 individual cracks per meter; and NG for 40 or more individual cracks per meter. Similarly, with respect to burring evaluation is indicated as: A for 0 to 50 μm; B for 50 to 100 μm; C for 100 to 150 μm; and NG for 150 μm or greater.

As shown in FIG. 8A, it can be determined that the optimum state is achieved when the male blade beveled portion 54 has a bevel dimension in the rotation axis direction (dimension D in FIG. 2) of 3 μm and the thickness of the secondary blade 56 provided to the male blade 30 (dimension C in FIG. 2) is 10 μm to 50 μm, the blade tip angle of the secondary blade 56 (angle B in FIG. 2) is 85° and the female blade bevel portion 58 has a bevel dimension in the rotation axis direction (dimension F in FIG. 2) of 4 μm.

The inkjet paper 11 slit in this manner is wound on the winding section 16, as shown in FIG. 9.

As described above, in order to manufacture inkjet paper, first the inkjet paper 11 is fed out with the feeder section 12 towards the slitting apparatus 13 (feed process). Next, the inkjet paper 11 that has been fed out from the feeder section 12 is slit in the slitting apparatus 13 (slitting process). Then, the slit inkjet paper 11 is wound using the winding section 16 (winding process).

As explained above, due to the top knives 30 slitting the inkjet paper 11 along the conveying direction from the support body paper 26 side, burring can be suppressed from being raised on the outside of the outer face of the paper 26 of the inkjet paper 11.

Due to suppressing a burr from being raised to the outside from the outside face of the paper 26, contact of burr against a support member and accompanying contamination can be suppressed when, in subsequent processes, the inkjet paper 11 is conveyed in a state in which the paper 26 is supported.

Furthermore, configuration is made such that the top knives 30 slit the inkjet paper 11 while the ink receiving layer 28 is in a supported state on the outer peripheral face of the female blade 36 (in an wrapped state). Therefore, the inkjet paper 11 can be slit by the top knives 30 in a stable state.

Due to being able to slit the inkjet paper 11 with the top knives 30 in a stable state, cracking and burring (raised burr) can be suppressed from occurring in the vicinity of the slit edge of the ink receiving layer 28 during slitting.

Furthermore, the blade tip angle of the top knives 30 (angle A in FIG. 2) is set at 15° to 30°. At the blade tip portions 30A of the top knives 30, there is provided the secondary blade 56 with a thickness (dimension C in FIG. 2) of 10 μm to 50 μm, and a blade tip angle (angle B of FIG. 2) of 60° to 85°. Therefore, cracking and burring (raised burr) can be efficiently suppressed from occurring in the vicinity of the slit edge of the ink receiving layer 28.

Furthermore, due to employing cemented carbide as the material of the male blade 30 and the female blade 36, the durability of the male blade 30 and the female blade 36 can be raised (working life can be prolonged).

Furthermore, due to employing an angle of 90° for the blade tip angle of the female blade 36, the female blade 36 is easily fabricated, and the durability of the female blade 36 can be further raised (working life can be prolonged).

Furthermore, the male blade 30 is provided with the male blade beveled portion 54 having a bevel dimension in the rotation axis direction (dimension D in FIG. 2) of 1 μm to 10 μm and a bevel dimension in the radial direction (dimension E in FIG. 2) of 10 μm to 100 μm. On the other hand, the female blade 36 is provided with the female blade bevel portion 58 having a bevel dimension in the rotation axis direction (dimension F in FIG. 2) of 1 μm to 10 μm and a bevel dimension in the radial direction (dimension G in FIG. 2) of 10 μm to 100 μm. Accordingly, the durability of the male blade 30 and the female blade 36 can be raised (working life can be prolonged).

The tension on the inkjet paper 11 to be slit by the slitting apparatus 13 is set in the range 130N/m to 686N/m. Therefore, cracks can be prevented from appearing in the inkjet paper 11 compared with cases in which the inkjet paper 11 is pulled at higher tension, and the inkjet paper 11 can be slit in a stable state.

The degree of overlap of the blade tip portions 30A of the top knives 30 and the blade tip portions 36A of the bottom knives 36 (dimension J in FIG. 2) is set in the range 0.8 mm to 1.0 mm. Accordingly the top knives 30 can be suppressed from riding up on the bottom knives 36, and the inkjet paper 11 can be prevented from undergoing large amounts of deformation during slitting.

The present invention is explained in detail according to particular exemplary embodiments, however the present invention is not limited by the exemplary embodiments. It will be obvious to someone of skill in the art that various other exemplary embodiments are possible within the scope of the present invention. For example, whereas in the above exemplary embodiments the male blade beveled portion 54 is set with a bevel dimension in the rotation axis direction (dimension D in FIG. 2) of 1 μm to 10 μm, configuration may be made at greater than 10 μm. Similarly, whereas in the above exemplary embodiments the female blade bevel portion 58 is set with a bevel dimension in the rotation axis direction (dimension F in FIG. 2) of 1 μm to 10 μm, configuration may be made at greater than 10 μm.

What is claimed is:

1. A slitting-material slitting apparatus comprising:

a rotatable male blade;

a female blade that is provided below the male blade so as to be capable of rotating about a rotation axis aligned with the rotation axis direction of the male blade, and is provided so as to face a blade tip portion of the male blade along the male blade rotation axis direction; and a wrap section that is configured to wrap a slitting-material around the female blade such that the slitting-material makes contact with the female blade on a coated layer side of the slitting-material, which includes a support body with a coating layer on the support body, the coating layer being harder than the support body;

wherein the relative position of the male blade and the female blade are determined such that the male blade slits the slitting-material in a state in which the coating layer is wrapped against the female blade by the wrap section and in contact with the female blade, wherein a blade tip angle of the male blade as viewed from the rotation direction of the male blade is 15° to 30°, and wherein a blade tip portion of the male blade is provided with a secondary blade that, when viewed from the rotation direction, has a rotation axis direction thickness of 10 μm to 50 μm and a blade tip angle of 60° to 85°.

2. The slitting-material slitting apparatus of claim 1, wherein a material of the male blade is cemented carbide.

3. The slitting-material slitting apparatus of claim 1, wherein a blade tip angle of the female blade is 90°.

4. The slitting-material slitting apparatus of claim 1, wherein:

a male blade beveled portion is provided to a blade tip portion of the male blade facing towards the female blade, the male blade beveled portion having a bevel dimension along the rotation axis direction of 1 μm or greater; and a female blade beveled portion is provided to a blade tip portion of the female blade facing towards the male blade, the female blade beveled portion having a bevel dimension along the rotation axis direction of 1 μm or greater.

5. The slitting-material slitting apparatus of claim 4, wherein the bevel dimension along the rotation axis direction of the male blade beveled portion is 10 μm or less and the bevel dimension along the rotation axis direction of the female blade beveled portion is 10 μm or less.

6. The slitting-material slitting apparatus of claim 1, wherein the material of the female blade is cemented carbide.

7. The slitting-material slitting apparatus of claim 1, wherein:

tension applied to the slitting-material is set in a range of 130N/m to 686N/m; and a degree of overlap of the male blade and the female blade is set in a range of 0.8 mm to 1.0 mm.

8. An inkjet paper manufacturing apparatus comprising:

a feeder section that feeds inkjet paper, which includes a support body with an ink receiving layer harder than the support body formed on the support body, to an inkjet paper conveying direction downstream side;

the slitting-material slitting apparatus of claim 1, which is provided on the conveying path of the inkjet paper and slits the inkjet paper that has been fed out by the feeder section along the conveying direction into a plurality of strips of inkjet paper; and a winding section that winds up the inkjet paper that has been slit by the slitting-material slitting apparatus.

9. A method of manufacturing inkjet paper, the method comprising:

feeding out inkjet paper, which includes a support body formed with an ink receiving layer harder than the support body on the support body, to a next process;

slitting, by using the slitting-material slitting apparatus of claim 1, the inkjet paper that has been fed out by the feeding process; and winding up the inkjet paper that has been slit in the slitting process.

* * * * *